US007474752B2

(12) United States Patent
Aarts et al.

(10) Patent No.: US 7,474,752 B2
(45) **Date of Patent: *Jan. 6, 2009**

(54) AUDIO FREQUENCY RANGE ADAPTATION

(75) Inventors: Ronaldus Maria Aarts, Eindhoven (NL); Okke Ouweltjes, Eindhoven (NL); Daniel Willem Elisabeth Schobben, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

This patent is subject to a terminal disclaimer.

(21) Appl. No.: 10/571,637

(22) PCT Filed: Aug. 31, 2004

(86) PCT No.: PCT/IB2004/051612

§ 371 (c)(1), (2), (4) Date: Mar. 14, 2006

(87) PCT Pub. No.: WO2005/027568

PCT Pub. Date: Mar. 24, 2005

(65) Prior Publication Data

US 2007/0098182 A1 May 3, 2007

(30) Foreign Application Priority Data

Sep. 16, 2003 (EP) ..... 03103398

(51) Int. Cl.
*H04R 29/00* (2006.01)

(52) U.S. Cl. ..... 381/59; 381/96; 381/98

(58) Field of Classification Search ..... 381/61, 381/59, 98, 96

See application file for complete search history.

(56) References Cited

U.S. PATENT DOCUMENTS

| | | | | |
|---|---|---|---|---|
| 5,068,903 | A * | 11/1991 | Walker | 381/96 |
| 5,481,617 | A * | 1/1996 | Bjerre | 381/108 |
| 6,134,330 | A * | 10/2000 | De Poortere et al. | 381/61 |
| 6,731,764 | B2 * | 5/2004 | Asada et al. | 381/152 |
| 7,136,493 | B2 * | 11/2006 | Coats et al. | 381/61 |
| 2003/0002684 | A1 * | 1/2003 | Coats | 381/61 |
| 2004/0120535 | A1 * | 6/2004 | Woods | 381/96 |

* cited by examiner

*Primary Examiner*—Vivian Chin
*Assistant Examiner*—Disler Paul

(57) ABSTRACT

To improve the reproduction of audio signals, the signal components of a selected audio frequency range (1) of an audio signal are concentrated in a narrower audio frequency range (II). This is achieved by detecting first signal components in the first audio frequency range (I), generating second signal components in the second audio frequency range (II), and controlling the amplitude of the second signal components in response to the amplitude of the first signal components. As a result, dedicated transducers may be used which are particularly efficient in the narrower frequency range. The original frequency range (I) may contain the lower frequency signal components (bass components) of the audio signal.

10 Claims, 3 Drawing Sheets

AUDIO FREQUENCY RANGE ADAPTATION

Figure 1:
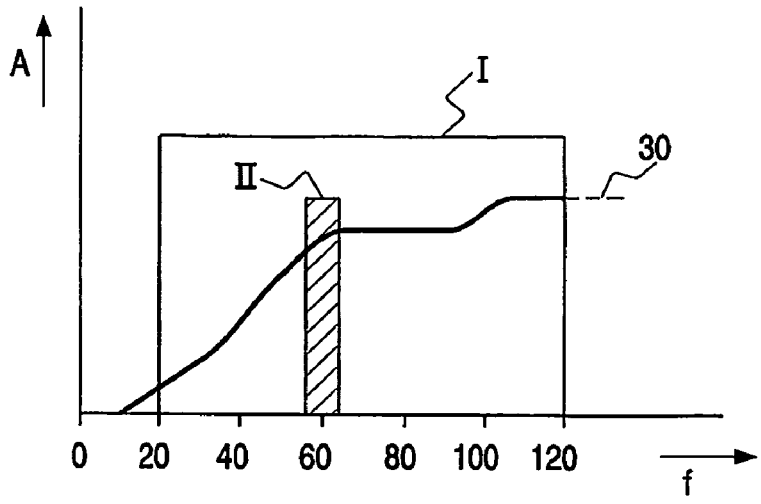

The present invention relates to audio frequency range reduction. More in particular, the present invention relates to a device and a method for adapting a frequency range of an audio signal, and to a system in which the device and/or the method is used.

It is well known that audio frequencies range from approximately 20 Hz to approximately 20 kHz. While the middle range (approx. 1-10 kHz) can be reliably reproduced by regular loudspeakers, special transducers are typically required for the lower and higher frequency ranges. High fidelity audio systems typically include small transducers (tweeters) for reproducing the high audio frequency range, and relatively large transducers (woofers) for the low range. The transducers required to faithfully reproduce the lowest audible frequencies (approx. 20-100 Hz) at a suitable sound volume take up a substantial amount of space. However, there is an increasing demand for miniature audio sets. It is obvious that the requirements of large transducers and small audio equipment are incompatible.

It has been proposed to solve this problem by using psychoacoustic phenomena such as "virtual pitch". By creating harmonics of low-frequency signal components it is possible to suggest the presence of such signal components without actually reproducing them.

United States Patent Application U.S. Pat. No. 6,134,330 (Philips), for example, discloses an audio system provided with enhancing means for enhancing the audio signal. These known enhancing means comprise a harmonics generator for generating harmonics of a first part of the audio signal so as to create the illusion that the perceived audio signal includes lower frequency components than are really available.

Although this known solution works remarkably well, it is no substitute for actually reproducing low-frequency (bass) signal components.

It is therefore an object of the present invention to overcome these and other problems of the Prior Art and to provide a device and a method for reproducing audio signals which allows a more efficient reproduction of the entire audio frequency range, and in particular of low-frequency signal components.

Accordingly, the present invention provides a device for adapting a frequency range of an audio signal, the device comprising:

means for detecting first signal components in a first audio frequency range, means for generating second signal components in a second audio frequency range, and means for controlling the amplitude of the second signal components in response to the amplitude of the first signal components, wherein the second audio frequency range is substantially narrower than the first audio frequency range, and wherein the transducer has a maximum sensitivity at the second audio frequency range.

By generating second signal components in a second audio frequency range which is substantially narrower than the first frequency range, the amplitude of the second signal components being controlled in response to the amplitude of the first signal components, the energy of the audio signal is concentrated in the second frequency range. As a result, the bandwidth of the first frequency range is effectively reduced and the energy of the audio signal is concentrated in a substantially narrower (second) range. This has the advantage that the energy of the audio signal can be concentrated in a range in which a transducer is particularly efficient, thus resulting in a more efficient sound production.

The sensitivity of the transducer preferably is the voltage sensitivity, that is, the ratio of the (output) sound pressure and the (input) voltage, although other measures are also possible, such as the efficiency, which may be defined as the ratio of the (output) acoustical power and the (input) electrical power.

The bandwidth reduction according to the present invention is especially effective at relatively low frequencies, as it allows low-frequency transducers to be used which are particularly efficient in a narrow frequency range. It is therefore preferred that the first frequency range has an upper boundary of not exceeding 200 Hz, preferably not exceeding 150 Hz, more preferably approximately 120 Hz.

In a preferred embodiment, the second audio frequency range is comprised in the first frequency range. This implies that the second audio frequency range is located within the first audio frequency range and that no frequencies are generated outside the original (first) audio frequency range. It effectively means that the second range is a sub-range of the first range. Although the beneficial effect of the present invention is already attained when the second range is a little narrower than the first range, for example 10% (that is, has a bandwidth which is reduced by 10%), it is preferred that the second range is substantially narrower, for example 50% or even more. Depending on the type of transducer being used, the second range may be very narrow and have a bandwidth of only a few hertz.

Accordingly, it is preferred that the second audio frequency range spans less than 50 Hz, preferably less than 10 Hz, more preferably less than 5 Hz. The second frequency range may even comprise only a single frequency, for example the resonance frequency of a transducer.

The second audio frequency range may be predetermined. In a particularly advantageous embodiment, however, the device according to the present invention, being connectable to a transducer for reproducing the audio signal, further comprises means for determining the second frequency range on the basis of transducer properties. In this embodiment the device is capable of determining transducer properties such as its impedance, and adjusting the second frequency range accordingly. This adjustment may take place prior to the actual use of the device, but may also take place during use, that is, continuously.

The present invention further provides a loudspeaker or transducer unit, such as a loudspeaker box, the unit comprising a device as defined above.

The present invention additionally provides a system for reproducing an audio signal, such as an audio (stereo) system, the system comprising an audio signal source, an amplifier and a transducer capable of converting the audio signal into sound, the system further comprising a device as defined above.

Furthermore, the present invention provides a method of adapting a frequency range of an audio signal, the method comprising the steps of:

detecting first signal components in a first audio frequency range, generating second signal components in a second audio frequency range, and controlling the amplitude of the second signal components in response to the amplitude of the first signal components, wherein the second audio frequency range is substantially narrower than the first audio frequency range, and wherein the transducer has a maximum sensitivity at the second audio frequency range. Preferably, the second frequency range is comprised in the first frequency range.

The present invention will further be explained below with reference to exemplary embodiments illustrated in the accompanying drawings, in which:

FIG. 1 schematically shows a first and a second frequency range in accordance with the present invention.

Figure 2:
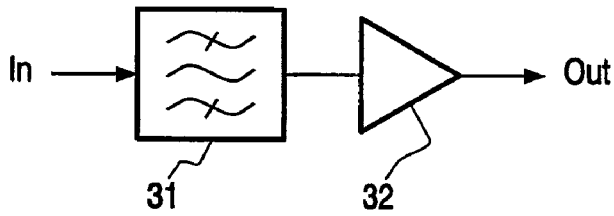
Figure 3:
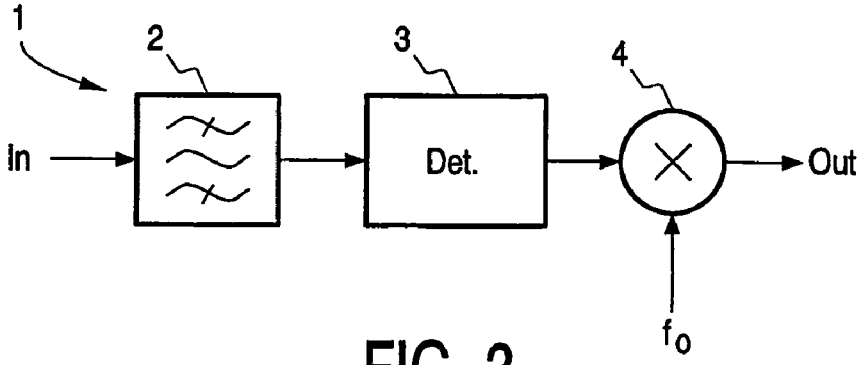
Figure 4:
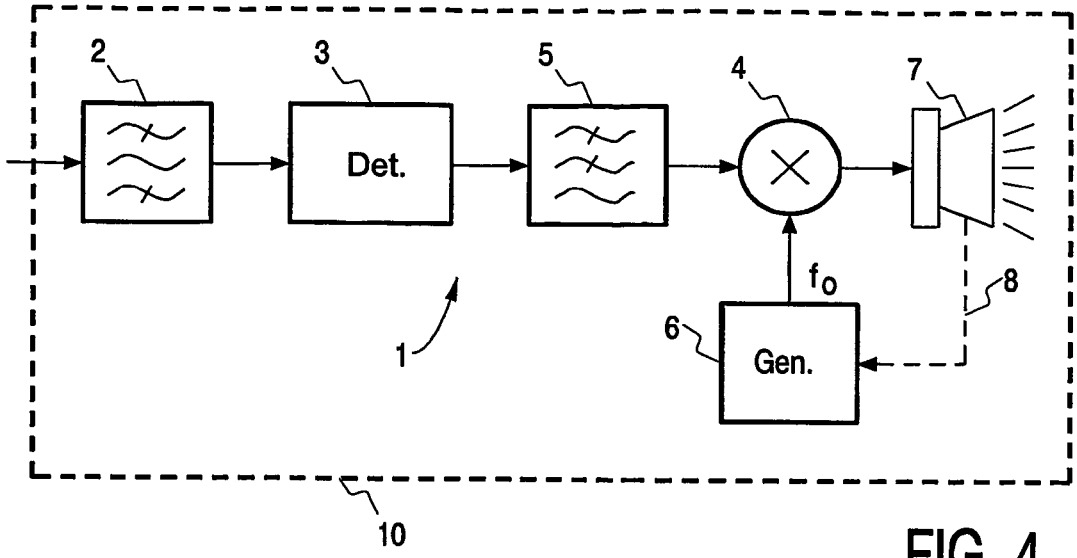
Figure 5:
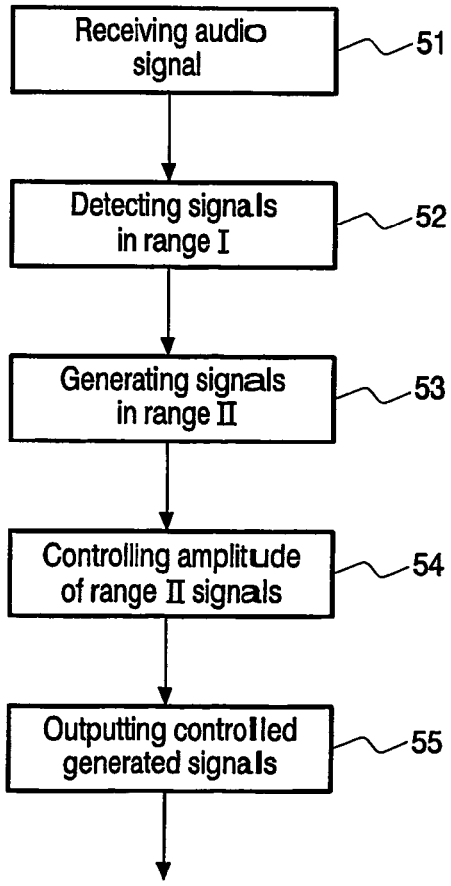
Figure 6:
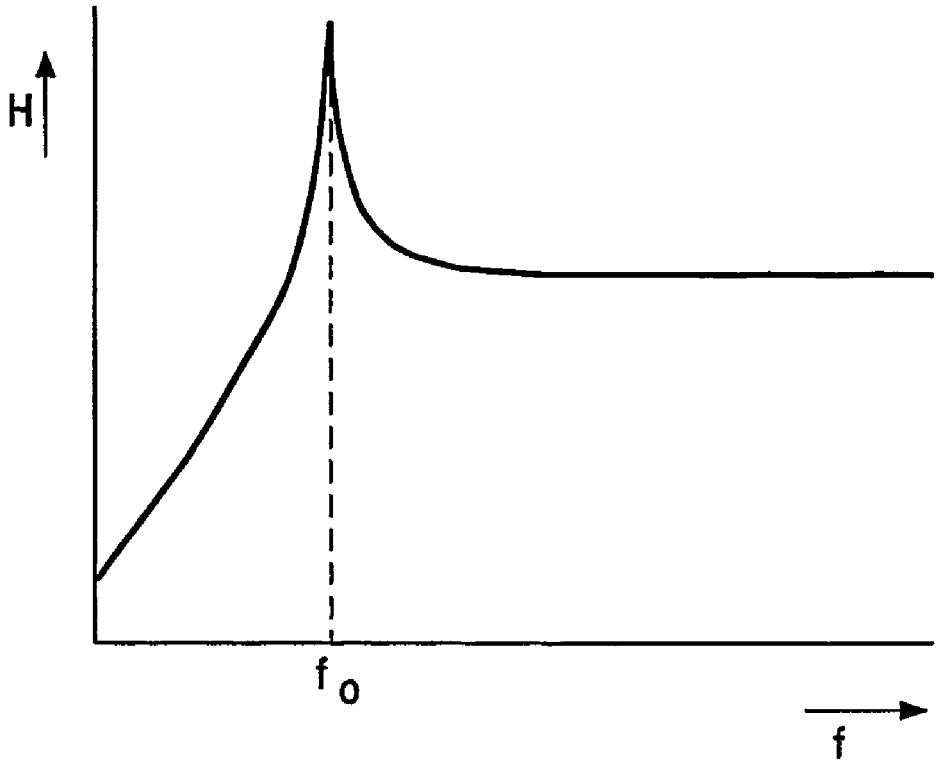

FIG. 2 schematically shows an arrangement for producing a limited bandwidth signal, FIG. 3 schematically shows a first embodiment of a device in accordance with the present invention, FIG. 4 schematically shows an second embodiment of a device in accordance with the present invention, FIG. 5 schematically shows a method in accordance with the present invention, FIG. 6 schematically shows the sensitivity of a transducer in relation to the frequency.

In FIG. 1 a graph showing an audio frequency distribution is schematically depicted. The graph 30 indicates the amplitude A (vertical axis) of an audio signal at a particular frequency f (horizontal axis). As shown, the audio signal contains virtually no signal components below approximately 10 Hz. As the following discussion will focus on the low-frequency part of the graph 30, the mid- and high-frequency parts of the graph have been omitted for the sake of clarity of the illustration.

In accordance with the present invention, a first frequency range is mapped onto a second, smaller frequency range which is preferably contained in the first frequency range. In the non-limiting example of FIG. 1, a first frequency range I is the range from 20 Hz to 120 Hz, while a second range II is the range around 60 Hz, for example 55-65 Hz. This first range I substantially covers the "low-frequency" part of an audio signal, whereas the second range II of FIG. 1 is chosen so as to correspond with a particular transducer, such as a loudspeaker, and will depend on the characteristics of the transducer. According to an important aspect of the present invention, the second range II preferably corresponds with the frequencies at which the transducer is most efficient, resulting in the highest sound production.

It will be understood that the size (bandwidth) of the second range II may also depend on the characteristics of the transducer(s). A transducer or array of transducers having a wider range of frequencies at which it is most efficient (possibly multiple resonance frequencies) will benefit from a wider second range II. Transducers or arrays of transducers having a single most efficient frequency (typically the resonance frequency) may benefit from an extremely narrow second range II as this will concentrate all energy in said single frequency.

It is noted that in the example shown the second range II is located within the first range I. This means that the first range I is effectively compressed and that no frequencies outside the first range are affected.

There are various ways of limiting the signals of range I to range II. In principle a band-pass filter, in the example shown centered around 60 Hz. However, this would cause most energy contained in the first range I to be lost. Some of that energy may be regained by using an amplifier. The arrangement of FIG. 2 shows a possible configuration with a first band-pass filter 31 and an amplifier 32, where the filter has a pass-band which is equal to the second range II. Although such an arrangement could effectively remove all frequencies not contained in the second range II, is suffers from serious drawbacks.

The main disadvantage of the arrangement of FIG. 2 is the fact that it produces no output signal when its input signal is outside the second range. An input signal of 40 Hz, for example (see FIG. 1), would be blocked by band-pass filter 31 and consequently the output signal would be zero. This problem is solved by the present invention.

The device 1 according to the present invention which is shown merely by way of non-limiting example in FIG. 3 comprises a band-pass filter 2, a detector 3 and a multiplier 4. The filter 2 has a pass-band which corresponds to the first range I, thus eliminating all frequencies outside the first range. The detector 3 detects the signal received from the filter 2. The detector 3 preferably is a peak detector known per se, but may also be an envelope detector known per se. In a very economical embodiment, the detector may be constituted by a diode.

The signal produced by the detector 3 represents the amplitude of the combined signals present within the first range I (see FIG. 1). Multiplier 4 multiplies this signal by a signal having a frequency $f_0$. This signal may be generated by a suitable generator (not shown in FIG. 3). The output signal of the multiplier 4 has an average frequency approximately equal to $f_0$ while its amplitude is dependant on the signals contained in the first frequency range I. By varying the generator frequency $f_0$, the average frequency and therefore the location of the second audio frequency range II can be varied.

Note that any signal contained in the first range I will cause an output signal (having a frequency equal to $f_0$) to be produced. In the example above, a 40 Hz signal would produce a zero output signal in the arrangement of FIG. 2. The device of the above embodiment of the present invention, however, does produce an output signal for a 40 Hz input signal.

In an alternative embodiment (not shown) of the device 1 of the present invention a controlled amplifier is arranged between the filter 2 and the detector 3 of FIG. 3. A control signal is fed to a control input of the amplifier to adjust the amplification. The control signal C is preferably equal to $$C=RMS(In*H1)/RMS(In*H2)$$

where In is the input signal at the input terminal of filter 2, * is the convolution sign, H1 is the transfer function of an ideal transducer and H2 is the transfer function of the actual transducer, while RMS (x) stands for the Root Mean Square value of x. Those skilled in the art of acoustics and/or electronics will be familiar with the concepts of convolution, transfer functions and RMS values. This embodiment allows the detected signal to be adjusted to the properties of the transducer.

Another embodiment of the device 1 of the present invention is shown in FIG. 4, where the device 1 is part of a system 10. The device 1 of FIG. 4 comprises a band-pass filter 2, a detector 3 and a multiplier 4, as in FIG. 3. In addition, the device of FIG. 4 comprises a low-pass filter 5 arranged between the detector 3 and the multiplier 4. This low-pass filter serves to remove any undesired frequencies which may be generated by the detection. The device 1 of FIG. 4 also comprises a generator 6 for generating a signal having a frequency $f_0$.

In addition to the device 1, the system 10 also comprises a transducer 7. This transducer may be a suitable loudspeaker, resonator or other transducer. Preferably, the transducer 7 is a loudspeaker driven at its resonance frequency. The transducer 7 may also be constituted by a "shaker", a device which indirectly produces sound by being capable of making another body vibrate.

Optionally, a control path 8 is present between the transducer 7 and the generator 6. This control path allows the generator 6 to adjust the frequency f0 (and preferably also the phase) in dependence of transducer parameters such as (instantaneous) impedance (or its absolute value), the actual movement of the vibration surface of the transducer, and/or sound pressure. It will be clear to those skilled in the art that these parameters make it possible to determine the efficiency (the output power divided by the input power) of the transducer. As the efficiency will typically vary with the frequency $f_0$, an adjustment of the frequency will allow the efficiency to be optimized. To this end the generator may introduce small (and possibly random) frequency variations to determine the efficiency at various frequencies around the current value of $f_0$. If at any of those values the efficiency is greater, the value of $f_0$ may be altered. It will be clear that this (optional) automatic tuning feature even further enhances the utility of the system.

In addition to, or instead of the control path 8 a further control path (not shown) between the transducer 7 and the band-pass filter 5. This further control path could adjust the bandwidth of filter 5 so as to determine the bandwidth of the second audio frequency range II.

The system 10 of FIG. 4 may optionally further comprise a band-pass filter arranged between the multiplier 4 and the transducer 7 to eliminate any undesired high frequency components. Additionally, or alternatively, a (power) amplifier may be arranged between the multiplier 4 and the transducer 7.

In the above discussion it has been assumed that only a single frequency $f_0$ is used. This is, of course, not essential and it will be clear that two or more frequencies $f_0$, $f_1$, etc. may be used to provide a second frequency range (II in FIG. 1) having suitable properties. Additionally, or alternatively, the first frequency range I may be subdivided into several sub-ranges, each of which is "compressed" into its respective second range. In this case, the first range may also contain the entire audio frequency range, approximately 20 Hz-20 kHz That is, the entire audio frequency range may be split up into several first ranges, each being concentrated into an individual second range.

The method according to the present invention is illustrated in FIG. 5. In a first step 51, one or more audio signals are received. In a second step 52, signals in a limited (first) range I are detected. In a third step 53, signals in a target (second) range II are generated ($f_0$ in FIGS. 3 and 4). In a fourth step 54, the amplitude of the signals in the target (second) range II is controlled, in accordance with the detected signals in range I (step 52). In a final step, the thus generated signals are output.

In FIG. 6 a graphical representation of the voltage sensitivity of an audio transducer is schematically depicted. The sound pressure level SPL (vertical axis) produced by the transducer is shown to vary with the frequency f (horizontal axis), the input voltage being held constant. As can be seen, the sound pressure level SPL and therefore the sensitivity H (H=pressure divided by voltage) is at a maximum at or near a frequency $f_0$. In accordance with the present invention, the frequency $f_0$ is substantially equal to the average frequency of the second audio frequency range (II in FIG. 1) and is, in the embodiment of FIGS. 3 and 4, substantially equal to the generator frequency. In accordance with a further aspect of the present invention, the frequency $f_0$ is the resonance frequency of the transducer.

The present invention is based upon the insight that concentrating the signal components of a frequency range in a relatively narrow band where transducers are most efficient allows a more effective use of the energy of the audio signals. The present invention benefits from the additional insight that certain transducers can be used particularly efficiently if they are tuned at particular frequency, such as their resonance frequency.

It is noted that the advantageous effects of the present invention are retained even when the input signal having a wider (first) frequency range is added to the output signal having a narrower (second) frequency range, as the frequency components outside the second range will typically not affect the dedicated transducer.

It is further noted that any terms used in this document should not be construed so as to limit the scope of the present invention. In particular, the words "comprise(s)" and "comprising" are not meant to exclude any elements not specifically stated. Single (circuit) elements may be substituted with multiple (circuit) elements or with their equivalents.

It will be understood by those skilled in the art that the present invention is not limited to the embodiments illustrated above and that many modifications and additions may be made without departing from the scope of the invention as defined in the appending claims.

The invention claimed is:

1. A device for adapting a frequency range of an audio signal to a transducer, the device comprising:

an input for receiving an audio signal;

means for detecting, in a first audio frequency range, an amplitude of first signal components the audio signal;

means for generating second signal components in a second audio frequency range;

means for controlling an amplitude of the second signal components in dependence on the detected amplitude of the first signal components; and an output, coupled to an output of said amplitude controlling means, for supplying said amplitude controlled second signal components to the transducer, wherein the second audio frequency range is substantially narrower than the first audio frequency range, and wherein the transducer has a maximum sensitivity in the second audio frequency range.

2. The device as claimed in claim 1, wherein the second frequency range is comprised in the first frequency range.

3. The device as claimed in claim 1, wherein the first audio frequency range has an upper boundary not exceeding 200 Hz.

4. The device as claimed in claim 1, wherein the second audio frequency range spans less than 50 Hz.

5. The device as claimed in claim 1, wherein said device further comprises:

means for determining the second audio frequency range on the basis of transducer properties.

6. The device as claimed in claim 5, wherein said device further comprises:

means for automatically adjusting the second frequency range on the basis of transducer properties.

7. A loudspeaker or transducer unit, comprising a device for adapting a frequency range of an audio signal to the transducer, the device comprising:

an input for receiving an audio signal;

means for detecting, in a first audio frequency range, an amplitude of first signal components in said audio signal;

means for generating second signal components in a second audio frequency range;

means for controlling an amplitude of the second signal components in dependence on the detected amplitude of the first signal components; and an output, coupled to an output of said amplitude controlling means, for supplying said amplitude controlled second signal components to said transducer, wherein the second audio frequency range is substantially narrower than the first audio frequency range, and wherein the transducer has a maximum sensitivity in the second audio frequency range.

8. A system for reproducing an audio signal, the system comprising an audio signal source, an amplifier and a transducer capable of converting the audio signal into sound, the system further comprising a device for adapting a frequency range of an audio signal to the transducer, the device comprising:

an input for receiving an audio signal;

means for detecting, in a first audio frequency range, an amplitude of first signal components in said audio signal;

means for generating second signal components in a second audio frequency range;

means for controlling an amplitude of the second signal components in dependence on the amplitude of the first signal components; and an output, coupled to an output of said amplitude controlling means, for supplying said amplitude controlled second signal components for said transducer, wherein the second audio frequency range is substantially narrower than the first audio frequency range, and wherein the transducer has a maximum sensitivity in the second audio frequency range.

9. A method of adjusting a frequency range of an audio signal to a transducer, the method comprising the steps of:

receiving an audio signal;

detecting, in a first audio frequency range, an amplitude of first signal components in said audio signal;

generating second signal components in a second audio frequency range;

controlling an amplitude of the second signal components in dependence on the amplitude of the first signal components; and supplying the amplitude controlled second signal components to the transducer, wherein the second frequency range is substantially narrower than the first frequency range, and wherein the transducer has a maximum sensitivity in the second audio frequency range.

10. The method as claimed in claim 9, wherein the second frequency range is comprised in the first frequency range.

* * * * *